United States Patent [19]

Humphrey

[11] Patent Number: 4,873,909

[45] Date of Patent: Oct. 17, 1989

[54] STRINGED MUSICAL INSTRUMENT

[76] Inventor: Thomas Humphrey, 124 W. 72 St., New York, N.Y. 10023

[21] Appl. No.: 220,485

[22] Filed: Dec. 8, 1987

Related U.S. Application Data

[63] Continuation of Ser. No. 913,690, Sep. 30, 1986, abandoned.

[51] Int. Cl.[4] ..... G10D 1/08

[52] U.S. Cl. ..... 84/293; 84/267; 84/291; 84/297 R

[58] Field of Search ..... D17/14, 20; 84/173, 84/263, 267–268, 291–294, 297 R

[56] References Cited

U.S. PATENT DOCUMENTS

| | | | |
|---|---|---|---|
| D. 281,075 | 10/1985 | Stolhand | D17/19 |
| 419,625 | 1/1890 | Barnard | 84/293 |
| 608,279 | 8/1898 | Benson | 84/293 |
| 860,137 | 7/1907 | Inskeep | 84/294 |
| 1,206,650 | 11/1916 | Bardsley | 84/293 |
| 1,755,019 | 4/1930 | Parker, Jr. | 84/291 |
| 2,588,101 | 3/1952 | Finder | 84/291 |
| 3,204,510 | 9/1965 | Hopf | 84/291 |
| 4,084,475 | 4/1978 | Horowitz | 84/291 |
| 4,317,402 | 3/1982 | McPherson | 84/291 |
| 4,320,684 | 3/1982 | Podunavac | 84/291 |
| 4,320,685 | 3/1982 | Pytlewski | 84/291 |
| 4,432,267 | 2/1984 | Feller | 84/293 |

FOREIGN PATENT DOCUMENTS

| | | | |
|---|---|---|---|
| 261945 | 7/1913 | Fed. Rep. of Germany | 84/293 |
| 359287 | 3/1906 | France | 84/307 |
| 8119 | 1/1908 | France | 84/307 |

*Primary Examiner*—Lawrence R. Franklin

*Attorney, Agent, or Firm*—Brumbaugh, Graves, Donohue & Raymond

[57] ABSTRACT

A stringed musical instrument, in particular a guitar, including a body with a soundboard having an upper portion, and a neck having one end connected to the upper portion of the soundboard so that a portion of the neck extends over the soundboard to a distal second end, the soundboard and neck are connected so as to form an obtuse angle therebetween so that a fingerboard located on the upper surface of the neck has an elevation from the soundboard which increases in the direction of the distal second end of the neck.

11 Claims, 2 Drawing Sheets

STRINGED MUSICAL INSTRUMENT

This application is a continuation of Ser. No. 913,690, filed 9/30/86, now abandoned.

BACKGROUND OF THE INVENTION

The present invention relates to the field of musical instruments, and more particularly to stringed instruments such as a guitar.

In the field of guitar manufacturing and designing it is a continuing objective to provide a guitar with richer and improved tonal qualities, as well as one which is easier for the guitarist to play. It is said that the guitar is the easiest instrument to play, but the most difficult to play well. There are generally two types of stringed instruments which require the use of both hands for playing without an intermediary component, these instruments being the harp and the guitar. The harp employs only open strings, whereas the guitar employs stopped strings. A significant drawback in prior art guitars is the manner in which the neck portion and the body portion of the guitar are connected. Traditionally, the neck and body are connected so that the fingerboard, fixed to the upper surface of the neck, is substantially flush with the upper surface of the body, known as the soundboard. The fingerboard is provided with a number of frets over which the strings pass. The frets generally are known by their number, i.e. 12th fret, the numbers beginning at the distal end of the fingerboard and increasing as they approach the soundboard. This configuration requires contortions and gyrations of the guitarist's hands which in themselves are nearly impossible to master let alone the additional problem of having to locate specific positions on the fingerboard of the instrument. What is generally considered to be the single most difficult hand motion is that of reaching the highest numbered frets which are above the 12th fret and are located on a portion of the fingerboard which rests on the soundboard and is substantially flush therewith. This motion involves what is known as the shift. To accomplish this shift the entire arm and body of the player must lean forward, and the arm must drop down to allow the hand to reach around and gain a new position above the soundboard of the instrument. After having accomplished this the hand and fingers must be forced down with tremendous pressure in order to make contact with the highest frets. Many times all of the fingers of the hand must be used in contacting the fret. Considering that such motions must be made in tempo both clearly and accurately, it is readily apparent that significant effort is necessary.

SUMMARY OF THE INVENTION

In view of the drawbacks of the prior art, it is an object of the present invention to provide a stringed instrument, particularly a guitar, which requires less-contorted hand manipulations when using the uppermost frets on the fingerboard.

Pursuant to this object, and others which will become apparent hereafter, one aspect of the present invention resides in a stringed musical instrument, such as a guitar, having a body portion connected at one end to a neck. The body has an upper surface, known as a soundboard. The neck and body are connected so as to create an obtuse angle between the neck and the soundboard. The neck is connected at a first end to the soundboard so that it extends over a portion of the soundboard to a distal end at which one end of the strings are fixed. The other end of the strings are fixed on the soundboard so that the strings pass over the fingerboard and a portion of the soundboard. The angular arrangement between the neck and the soundboard causes the fingerboard to be elevated from the surface of the soundboard, the elevation of the fingerboard increasing from the first end of the neck in the direction of the distal end. Due to this elevation, the outer palm area of the hand no longer hits the body of the guitar, and the previously mentioned hand contortions are no longer as difficult when using the uppermost frets, as would normally occur with a conventional instrument.

The angular pitch of the soundboard is provided so that the strings will approach the soundboard from a much steeper angle, thus placing an extremely different tension on the entire soundboard causing it to respond to the energy and signal of the string with a much fuller and voluminous response.

The angle of approach caused by the elevation of the neck produces a decreased string tension, making left-hand positioning considerably easier. This softness of the strings also provides the ability to produce a greater vibrato and sustain.

The lack of need for difficult hand manipulations, and the ease of access to the uppermost frets provided by the present invention have a great number of side benefits, namely: increased speed in reaching a good hand position; reducing anxiety in the player when playing above the 12th fret so that he may concentrate on the entire piece being played rather than be intimidated by certain passages; and the ability for the player to utilize the bass strings in the uppermost positions. These uppermost bass note positions are normally avoided on a conventional guitar because of their inferior tonal quality and the difficulty in reaching the positions. With the present invention the player now has the option of playing the same notes using low strings in high positions or higher strings in lower positions.

A further benefit of the angle between the neck and soundboard is that it allows the player to extend his arms out further from the shoulder area than was possible with prior guitars. This allows the player to sit more upright when playing and thus results in greatly reduced body tension during play as compared with conventional guitars.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
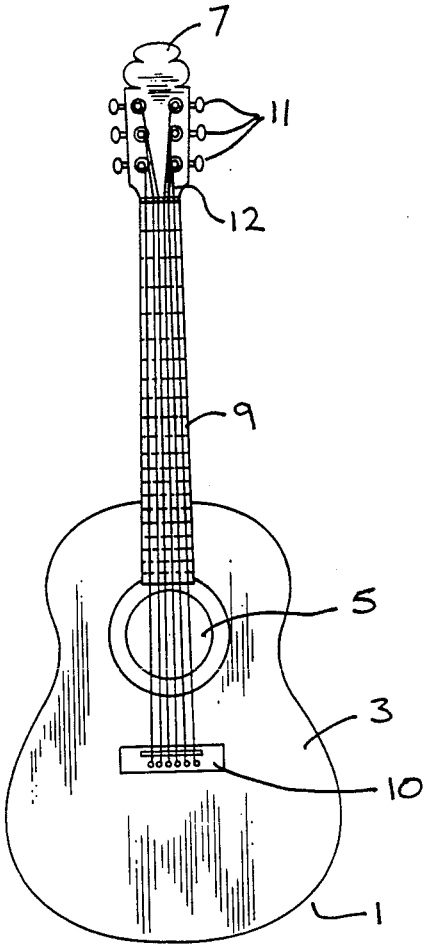
FIG. 1 is a front view of a guitar pursuant to an embodiment of the present invention.
Figure 2:
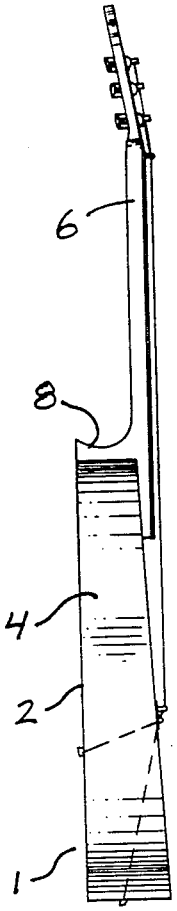
FIG. 2 is a side view of the guitar in FIG. 1.

As can be seen in FIGS. 1 and 2, the body 1 of the guitar is hollow and is constructed of a back 2 and a soundboard 3 which are separated and connected together by a sidewall 4 so as to define a hollow inner chamber. The soundboard 3 is provided at its upper portion with a soundhole 5 which gives access to the hollow inner chamber of the body 1. An elongated neck 6 is attached to the upper portion of the soundboard 3 by a descending heel portion 8 so that the neck 6 extends from a first end adjacent to the hole 5 over the upper portion of the soundboard 3 to a second distal end which supports a head 7. The heel portion 8 connects the lower side of the neck 6 to the sidewall 4 at the upper portion of the body. The soundboard 3 slants downward in the direction of the neck 6 so that an obtuse angle is created between the neck and the soundboard. This angular relationship can also be achieved by slanting the neck 6 or slanting both the neck 6 and the soundboard 3. Due to this angular relationship, a fingerboard 9 which is fixed to the top surface of the neck 6, is elevated from the surface of the soundboard 3 so that the elevation of the fingerboard 9 increases in the direction of the distal end of the neck 6 which holds the head 7. A side benefit of the body being shaped in this way is that the internal air column is altered by expansion and contraction of the air, thereby eliminating the presence of wolf tones also known as dead notes.

A plurality of strings 12 extend over the fingerboard 9 from the head 7 to a bridge 10. The bridge 10 is located on the portion of the soundboard 3 which is on the opposite side of the soundhole 5 from where the neck 6 is connected to the soundboard 3.

A plurality of turnkeys 11 are provided on the head 7 so that each one of the turnkeys 11 holds a respective string extending from the bridge 10 and over the fingerboard 9. The turnkeys 11 act to both hold and tune the individual strings.

Figure 3:
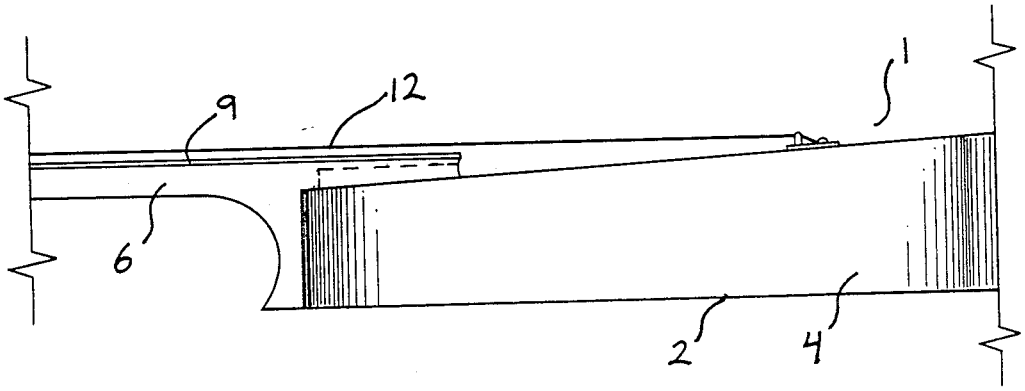
FIG. 3 is an enlarged view of the connection between the neck and body of the embodiment in FIGS. 1

In a further embodiment of the invention, the portion of the neck 6 which extends over the soundboard 3 is undercut, as indicated by the dashed lines in FIG. 3, so as to form an opening.

As previously described, the strings generally attach to the bridge, but in further embodiments they may also penetrate through the soundboard 3 of the instrument and fasten in either the back 2 or the sidewall 4 at the bottom portion of the instrument, as shown by dashed lines in FIG. 2.

While the invention has been illustrated and described as embodied in a stringed musical instrument such as a guitar, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without emitting features that, from the standpoint of prior art, readily constitute essential characteristics of the generic or specific aspects of this invention.

What is claimed is new and desired to be protected by Letters Patent is set forth in the appended claims.

I claim:

1. A guitar comprising: a body including a soundboard and a bottom interconnected by a sidewall; an elongated neck having an upper surface, a first end portion that extends on the soundboard and is fixed thereto, and a second free end; a fingerboard fixed to the upper surface of said neck, such that a portion of the fingerboard extends over the soundboard; wherein the upper surface of the neck and the fingerboard, in the portion extending over the soundboard, are elevated a distance above the soundboard, and wherein the neck and soundboard are arranged at an obtuse angle relative to one another so that the elevation of the neck upper surface and fingerboard relative to said soundboard increases in the direction of the free end of the neck; means on the free end of the neck for holding one end of each of a plurality of strings; and means for securing the other end of the strings to the body so that said strings extend along said fingerboard; said means including a bridge having a saddle over which the strings are directed to apply a downward force thereon.

2. A guitar as defined in claim 1, wherein the portion of the neck which extends on the soundboard is undercut so as to form an open passage between the soundboard and neck upper surface.

3. A guitar as defined in claim 1, wherein the bridge is fixed to the soundboard, and includes anchor means for securing the string ends; wherein the strings extend from the anchor means, over the saddle, and thereafter, at an obtuse angle relative to the soundboard, to the free end of the neck.

4. A guitar as defined in claim 3, in which the body is hollow, wherein the soundboard is provided with a soundhole between the bridge and neck, and wherein the neck extends on the soundboard to the sound hole.

5. A guitar as defined in claim 4, wherein the portion of the neck which extends on the soundboard is undercut so as to form an open passage between the soundboard and neck upper surface.

6. A guitar as defined in claim 1, wherein the soundboard and bottom of the body each lie substantially in a plane; wherein the fingerboard is parallel with the bottom of the body; and wherein the soundboard slants downwardly toward the body in a direction toward the neck to create the obtuse angle.

7. A guitar as defined in claim 6, wherein the portion of the neck which extends on the soundboard is undercut so as to form an open passage between the soundboard and neck upper surface.

8. A guitar as defined in claim 6, wherein the bridge is fixed to the soundboard, and includes anchor means for securing the string ends; wherein the strings extend from the anchor means, over the saddle, and thereafter, at an obtuse angle relative to the soundboard, to the free end of the neck.

9. A guitar as defined in claim 8, in which the body is hollow, wherein the soundboard is provided with a soundhole between the bridge and neck, and wherein the neck extends on the soundboard to the sound hole.

10. A guitar as defined in claim 9, wherein the portion of the neck which extends on the soundboard is undercut so as to form an open passage between the soundboard and neck upper surface.

11. A guitar as defined in claim 1, wherein the soundboard and bottom of the body lie in substantially parallel planes; and wherein the neck slants downwardly from the second end of said neck to said first end to create the obtuse angle.

* * * * *

UNITED STATES PATENT AND TRADEMARK OFFICE

CERTIFICATE OF CORRECTION

PATENT NO. : 4,873,909

DATED : Oct. 17, 1989

INVENTOR(S) : Humphrey

It is certified that error appears in the above-identified patent and that said Letters Patent is hereby corrected as shown below:

Col. 2, line 62, delete "and"; line 64, "FIGS. 1 and" should read --FIGS. 1 and 2;--. Col. 3, line 17, after "body." insert --In Figure 3, the plane of the fingerboard is shown parallel to the back of the guitar.--; line 18, after "downward" insert --relative to the back of the guitar,--; lines 20-22, delete "This angular ... soundboard 3."; between lines 31 & 32, insert --In Figure 4 the obtuse angular relationship between fingerboard and soundboard is effected by angling the neck relative to the soundboard. In this embodiment, the planes of the soundboard and back of the guitar are parallel.

Figure 5:
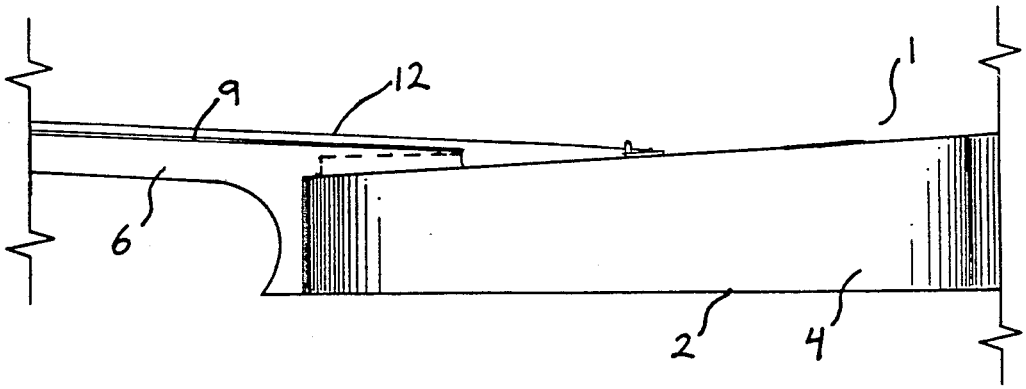
FIG. 5 is a view similar to FIG. 3 of a third embodiment.

--Figure 5 illustrates another alternative in which the soundboard is angled downwardly toward the neck relative to the back of the guitar and the neck is angled downwardly toward the guitar body from head 7 (not shown in this figure).--

Figure 4:
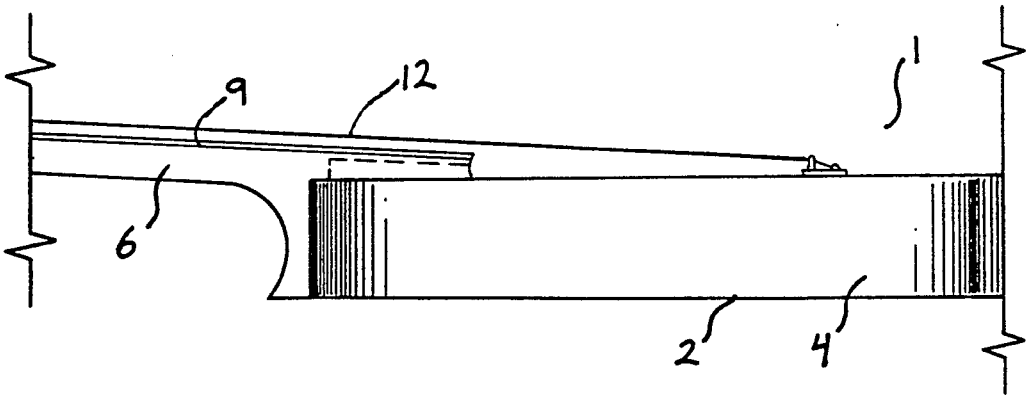
FIG. 4 is a view similar to FIG. 3 of a second embodiment of the invention.

Col. 3, lines 33-34, "located on" should read --fixed to--; line 51, after "FIG. 2." insert --As can be seen in Figures 3-5, the straight line defined by strings 12 in the region above the fingerboard also forms, when extended, an obtuse angle with the soundboard.--; line 62, "emitting" should read --omitting--. Col. 4, line 15, "means" should read --first means--; line 16, "means" should read --second means--;

UNITED STATES PATENT AND TRADEMARK OFFICE

CERTIFICATE OF CORRECTION

PATENT NO. : 4,873,909

DATED : Oct. 17, 1989

INVENTOR(S) : Humphrey

It is certified that error appears in the above-identified patent and that said Letters Patent is hereby corrected as shown below:

Col. 4, line 18, "means" should read --second means--.

Signed and Sealed this

Twenty-second Day of January, 1991

*Attest:*

HARRY F. MANBECK, JR.

*Attesting Officer*

*Commissioner of Patents and Trademarks*